United States Patent [19]

Eakes

[11] 4,123,921

[45] Nov. 7, 1978

[54] DYEING SYSTEM

[76] Inventor: James H. Eakes, P.O. Box 609, Cartersville, Ga. 30120

[21] Appl. No.: 825,942

[22] Filed: Aug. 19, 1977

[51] Int. Cl.[2] ..... D06B 1/08

[52] U.S. Cl. ..... 68/22 R; 28/288; 68/22 B; 68/200; 118/412; 118/414

[58] Field of Search ..... 68/22 R, 22 B, 200, 68/202, 203, 204, 205 R, 205 E, 206; 28/288; 118/410, 411, 412, 414; 8/155.2

[56] References Cited

U.S. PATENT DOCUMENTS

| | | | |
|---|---|---|---|
| 1,515,556 | 11/1924 | Dreaper | 28/288 |
| 2,160,989 | 6/1939 | Rubinstein | 28/288 |
| 2,720,100 | 10/1955 | Wiskemann | 68/205 E |
| 2,764,012 | 9/1956 | Dooley | 68/205 E |
| 2,897,576 | 8/1959 | Stuewer et al. | 28/288 |
| 3,541,635 | 11/1970 | Crenshaw et al. | 8/155.2 |
| 3,768,283 | 10/1973 | Bold et al. | 68/22 R X |

FOREIGN PATENT DOCUMENTS

| | | | |
|---|---|---|---|
| 1,384,759 | 11/1964 | France | 68/22 B |

*Primary Examiner*—Philip R. Coe
*Attorney, Agent, or Firm*—Jones, Thomas & Askew

[57] ABSTRACT

Annular shaped packages of yarn and the like are draped about a pair of rolls rotatable about horizontal axes. The rolls are moved apart to apply tension to the package, and a squeeze roll is urged toward one of the other rolls and against the package. One of the rolls is rotated to move the yarn package about the rolls, and liquid dye is applied to a downwardly moving portion of the package above the squeeze roll.

10 Claims, 4 Drawing Figures

DYEING SYSTEM

BACKGROUND

When yarn is to be dyed, a conventional procedure is to arrange the yarn in loose skeins, hang the skeins from supports, and then submerge the skeins and their supports in a dye bath. It is usually important to circulate the liquid dye bath throughout the individual yarns in each of the skeins so as to assure that all of the yarn is dyed a uniform color. This usually requires the yarns in the skein to be loosely supported in a large volume, low density arrangement to assure the proper circulation of a liquid dye bath between the yarns in the skein.

When yarns are formed in an arrangement which is not a conventional annular skein arrangement, or if the yarns are formed in a dense accumulation, it is more difficult to maintain the arrangement of the yarns during the dyeing process and it is more difficult to cause the dye liquor to contact all of the yarns.

SUMMARY OF THE INVENTION

Briefly described, the present invention comprises apparatus for expediently and uniformly dyeing yarn and the like while the yarn is arranged in a dense accumulation. The yarn is formed in an annular shaped package, the package is placed about two horizontal rolls, the rolls are moved vertically apart to apply tension to the package, and at least one of the rolls is rotated to move the package about the rolls. A squeeze roll is urged toward the lower one of the rolls and into contact with the package, and dye applicators are located above the squeeze roll on opposite sides of the downwardly moving portion of the package to apply the dye liquor to the yarn. The force of the squeeze roll against the package tends to squeeze the package and force the air out of the package, while trapping the dye liquor in a puddle against the package, thereby wetting and squeezing the dye liquor into the package.

The annular shaped package can be formed from a conventional skein of yarn, or the package can be formed in other annular arrangements, such as in a sine wave form within an annular pacakge as illustrated in U.S. Pat. No. 3,981,055. If the annular shaped arrangement of yarn is self-supporting while draped about the rolls, it may not be necessary to extend an outer covering about the package; however, if the annular shaped package is not self supporting, it is necessary to place the yarn within an annular shaped pervious package during the yarn dyeing procedures.

Thus, it is an object of this invention to provide apparatus for dyeing or otherwise treating annular shaped packages of yarn and the like whereby the yarn is rapidly and uniformly treated in a cold dye procedure with a minimum hazard of operator's error.

Another object of this invention is to provide apparatus for dyeing and otherwise treating annular shaped packages of yarn and the like, with the apparatus to uniformly and expediently treat densely formed packages of yarn and the like.

Other objects, features and advantages of the present invention will become apparent upon reading the following specification, when taken in conjunction with the accompanying drawings.

DETAILED DESCRIPTION

Figure 1:
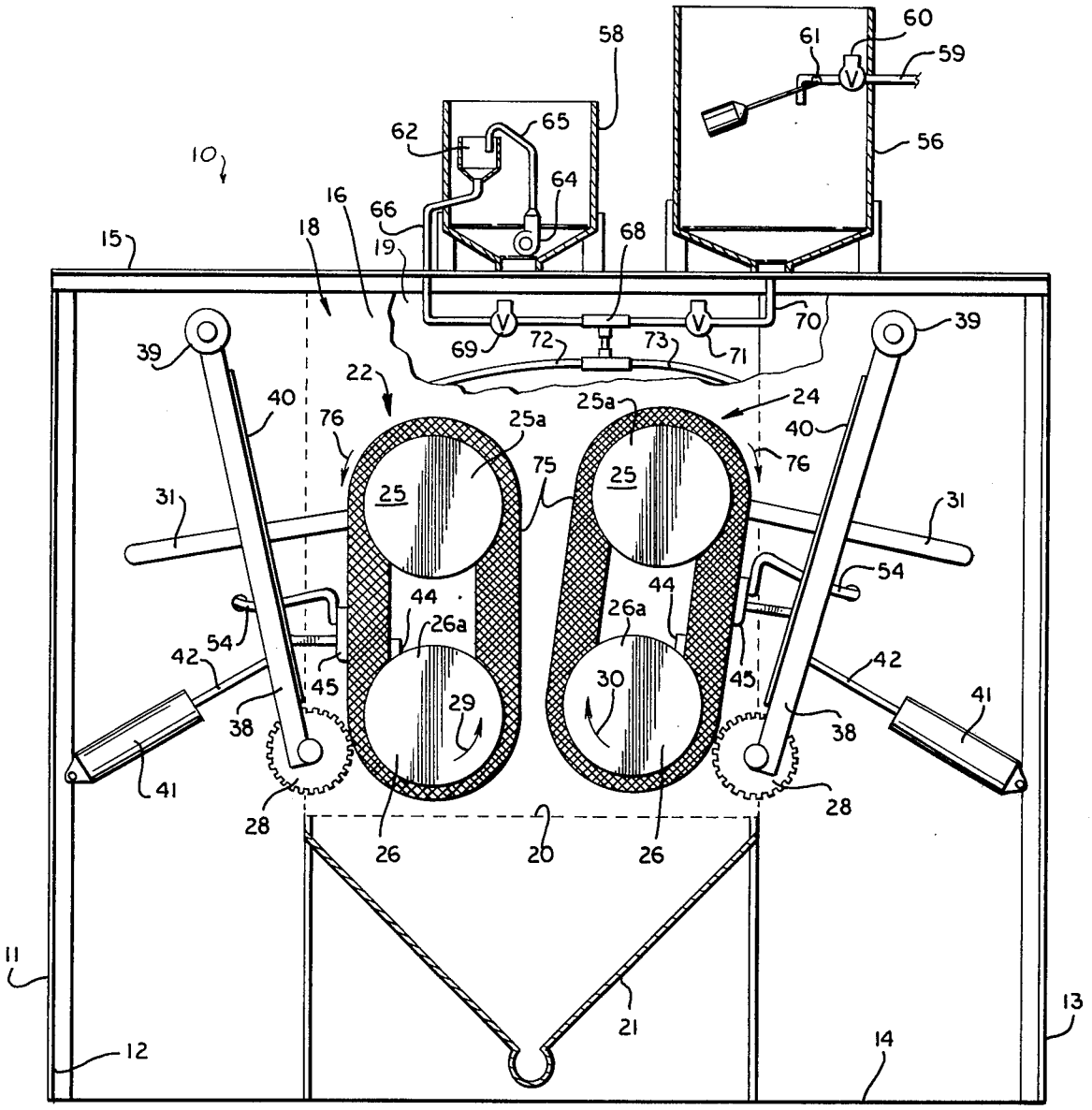
FIG. 1 is a side elevational view of the dyeing system, with parts broken away and with parts shown in cross section.

Referring now in more detail to the drawings, in which like numerals indicate like parts throughout the several views, FIG. 1 illustrates the dyeing system 10 with an external housing 11. The housing 11 is illustrated in the disclosed embodiment as having side walls 12 and 13, bottom wall 14, and top wall 15. An internal partition 16 separates the interior of the housing into an operating area 18 (in front of the internal partition 16) and a control area behind the partition. Back wall 19 is located behind partition 16, and the front wall and door are not illustrated in FIG. 1. The door opening is indicated by dash line 20. Drain pan 21 is located in the operating area 18 beneath the door opening 20.

Figure 2:
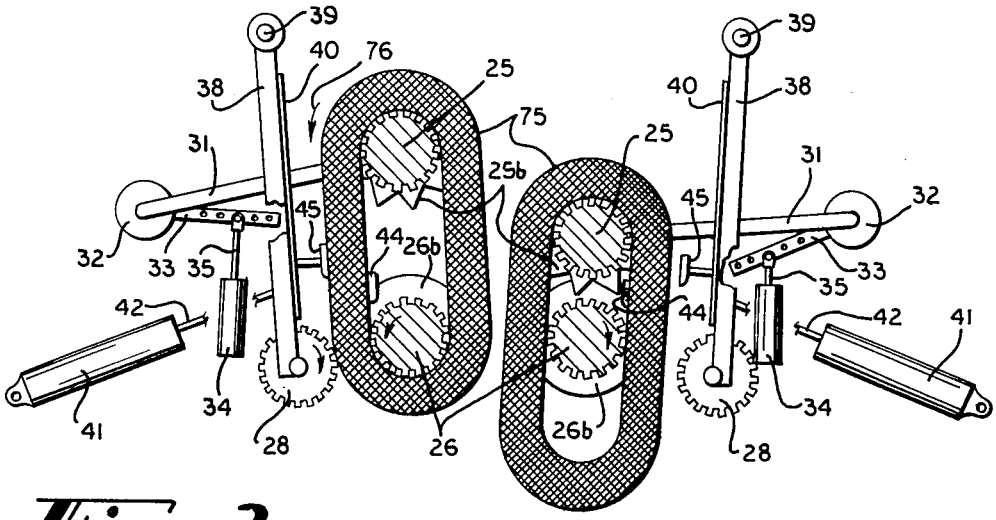
FIG. 2 is a schematic side elevational view of the dyeing system, with the group of dye rolls illustrated in the left portion of the figure illustrated in operating position and with the group of dye rolls illustrated in the right portion of the figure illustrated at rest.
Figure 4:
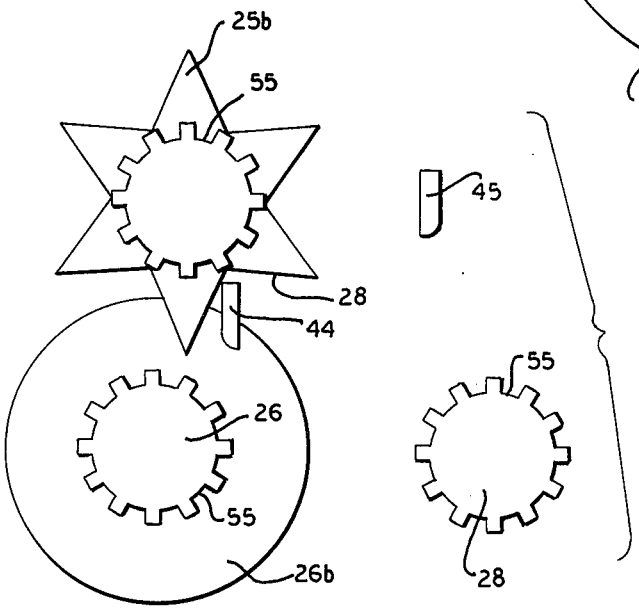
FIG. 4 is a detail schematic side elevational view of the rolls and dye applicators when the elements are in their positions to place a package on or to remove a package from the system.

The first group of dye rolls 22 are located in the left portion of the operating area 18 of housing 11, and a second group of dye rolls 24 are located in the right portion of the operating area (FIG. 1). Both groups of dye rolls are the same in shape and function, with the arrangement being reversed from one to the other. Each group of dye rolls 22 and 24 includes an upper roll 25, a lower driving roll 26, and a lower squeeze roll 28. The rolls 25, 26 and 28 are approximately equal in diameter and in length, with the rolls 25 and 26 having end flanges mounted thereon. The end flanges illustrated in FIG. 1 are the outermost end flanges **25*a* and 26*a*, and the end flanges illustrated in FIGS. 2 and 4 are the inner end flanges 25*b* and 26*b*. The outer end flanges 25*a* and 26*a* and the inner end flange 26*b* are all disc shaped while the inner end flange 25*b* of the upper roll 25 includes a series of slots 28 thereabout, and the end flanges 25*a* and 25*b* of the upper roll 25 are offset horizontally from the end flanges 26*a* and 26*b* of the lower driving roll 26**.

Lower rolls 26 of both groups of dye rolls 22 and 24 are driving rolls and a motor (not shown) in the control section behind the internal partition 16 in housing 11 operates to rotate the lower driving rolls 26 in the directions indicated by arrows 29 and 30.

Upper rolls 25 of both groups of dye rolls 22 and 24 are each supported at the end of support shaft 31, and the support shaft 31 is part of a crank assembly (FIG. 2) that includes support shaft 31, bearing 32, crank arm 33 and fluid powered cylinder 34. Crank arm 33 and cylinder 34 are located in the control section of the housing, behind the internal partition 16, and the ramrod 35 of cylinder 34 can be connected at various positions along the crank arm 33 so as to vary the force applied to the support arm 31. When the cylinder 34 is pressurized, the support arm 31 moves the upper roll 25 to its up position as illustrated in FIG. 1 and as illustrated in the left portion of FIG. 2, and when the cylinder 34 retracts its ramrod 35, the support arm 31 and upper roll 25 moves in a downward arc so that the upper roll 25 moves toward the lower driving roll 26, as illustrated in the right portion of FIG. 2.

The second lower roll or squeeze roll 28 of each group of dye rolls 22 and 24 is located at a level below upper roll 25 and adjacent lower driving roll 26 in each group of dye rolls 22 and 24. Squeeze roll 28 is rotatable about a horizontal axis which is parallel to the axes of upper roll 25 and lower driving roll 26 and is supported at the lower portion of support arm assembly 38. Support arm assembly 38 is swingably mounted at its upper end on bearing rod 39 and the bearing rod is supported at its opposite ends by the housing structure. A face plate 40 is supported on the support arm assembly 38 so as to form a side wall to the operating area 18 within housing 11 (FIG. 1). Fluid operated cylinders 41 are each supported at one end within housing 11 and their ramrods 42 are connected to one of the support arms 38. When the fluid cylinders 41 retract their ramrods 42, the squeeze rolls 28 are moved away from the lower driving rolls, and when the fluid cylinders distend their ramrods 42, the squeeze rolls 28 are moved toward the lower driving rolls 26.

Dye applicators 44 and 45 are associated with both groups of dye rolls 22 and 24, with the dye applicator 44 of each group of dye rolls being located over lower driving roll 26, and with the dye applicator 45 being located over squeeze roll 28. The dye applicators 44 and 45 are substantially identical in construction, with each including a conduit 46 with an elongated internal opening 48, a series of openings 49 extending downwardly through the wall of the conduit, and a slotted bar 50 attached to and supported by the conduit 46 and defining a trough 51 that is open on one side and which communicates with the openings 49 of the conduit. The trough 51 of dye applicator 44 faces the trough 51 of the dye applicator 45.

The dye applicator 44 in each group of dye rolls 22 and 24 is rigidly mounted within housing 11, and the conduit 46 extends through the internal partition 16 of the housing and over the flange **26*b* of the lower driving roll 26, with the series of openings 49 located in the portion of the conduit 46 which is over the lower driving roll 26, and with the trough 51 being located between the end flanges 26*a* and 26*b* of the lower driving roll 26. Thus, the lower bar 50 extends between the end flanges 26*a* and 26*b*** so as to locate as small amount of hardware over the flanges as necessary.

Dye applicator 45 of each group of dye rolls 22 and 24 is mounted on the support bar assembly 38 of lower squeeze roll 28 and is movable in unison with the squeeze roll about the upper bearing rod 39. A flexible conduit 54 is connected to the end of the conduit 46 of each dye applicator 45 to permit the dye applicator to move with the squeeze roll 28.

The external cylindrical surfaces of all of the rolls 25, 26 and 28 of both groups of dye rolls 22 and 24 are formed with slots 55.

Water container 56 and dye container 58 are located on top of housing 11. Conduit 59 supplies water to container 56, and solenoid valve 60 and float valve 61 control the flow of water into water container 56. Dye container 58 includes a small dye pot 62 therein and a small pump 64. The dye container 58 is usually filled with a dye liquor, and pump 64 pumps the dye liquor upwardly through its conduit 65 to the smaller dye pot 62 which is sized so as to contain a predetermined amount of dye liquor when it is filled to overflowing capacity. Outlet conduit 66 from the smaller dye pot 62 extends into the control area of housing 11 to I-connection 68. Solenoid valve 69 is located in conduit 66 and controls the flow of dye liquor from the dye pot 62. Conduit 70 extends from the lower portion of water container 56 to the other side of I-connection 68, and solenoid valve 71 controls the flow of water through the conduit 70. Conduits 72 and 73 extend from the I-connection 68 and communicate with both of the dye applicators 44 and 45 of both of the groups of dye rolls 22 and 24.

OPERATION

When the dye system 10 is to be placed in operation, the dye container 58 is filled with a dye liquor and the pump 64 in the container 58 is operated to fill the dye pot 62 until the dye pot overflows, whereupon the dye pot contains the proper amount of dye liquor and the operation of the pump is terminated. Solenoid valve 60 of the water container 56 is opened to allow water to fill the water container 56, and the float valve 61 cuts off the flow of water after a predetermined amount of water is present in the container 56. The solenoid valve 60 is closed after the container has been filled.

The fluid actuated cylinders 34 and 41 of both groups of dye rolls 22 and 24 are retracted so as to swing the squeeze rolls 28 away from the lower driving rolls 26, and so as to move the upper rolls 25 down toward the lower driving rolls 26. When the upper rolls 25 approach the lower driving rolls 26, the end flanges of the rolls are horizontally offset so that the flanges overly each other, and one of the slots 28 (FIG. 4) of each of the end flanges **25*b* is inserted about a dye applicator 44, which allows the upper rolls 25 to move closely adjacent the lower driving rolls 26**.

Annular shaped yarn packages 75 are then draped over the upper roll 25 and the lower driving rolls 26, with the yarn packages being located between the end flanges of both the upper and lower rolls. When one or both groups of dye rolls 22 and 24 have the annular shaped packages draped thereover as described, the fluid actuated cylinders 34 are distended so as to lift the upper rolls 25 from their lowered position (right portion of FIG. 2) to their upper positions (FIG. 1 and the left portion of FIG. 2), which causes tension to be applied to the annular shaped yarn packages 75 draped over the rolls. The operator then causes the fluid actuated cylinders 41 to distend, which brings the squeeze rolls 28 toward the lower driving rolls 26 and into squeezing engagement with the annular shaped packages of yarn. Also, the dye applicators 45 move in unison with the squeeze roll toward engagement with the annular shaped package.

The operator then energizes the driving motor (not shown) so that the lower driving rolls 26 are rotated in the directions indicated by arrows 29 and 30, which causes the annular shaped packages to be moved in the directions indicated by arrows 76, which causes the annular shaped packages to move about upper rolls 25 and lower driving rolls 26, and to cause the portion of the package adjacent the dye applicators 44 and 45 to move in a downward direction past the dye applicators and then between squeeze rolls 28 and lower driving rolls 26. The liquid flow from dye liquor container 58 and water container 56 can be controlled as best suited for the particular material being dyed and the dye liquor to be used. For example, the operator can open solenoid valve 71 to allow water to flow from the water container 56 to both of the dye applicators 44 and 45. After a predetermined amount of water has passed through the dye applicators to wet the yarn, the operator then opens solenoid valve 69 which allows the liquid dye to move from the dye pot 62 to the dye applicators 44 and 45. The solenoid valve 69 can be opened before all the water has been drained from the water container 56 so as to deliver a mixture of water and dye liquor to the dye applicators, or the water flow can be terminated by depletion of the water supply in water container 56 or by the closing of solenoid valve 71, whereby only the dye liquor will be directed to the dye applicator.

Figure 3:
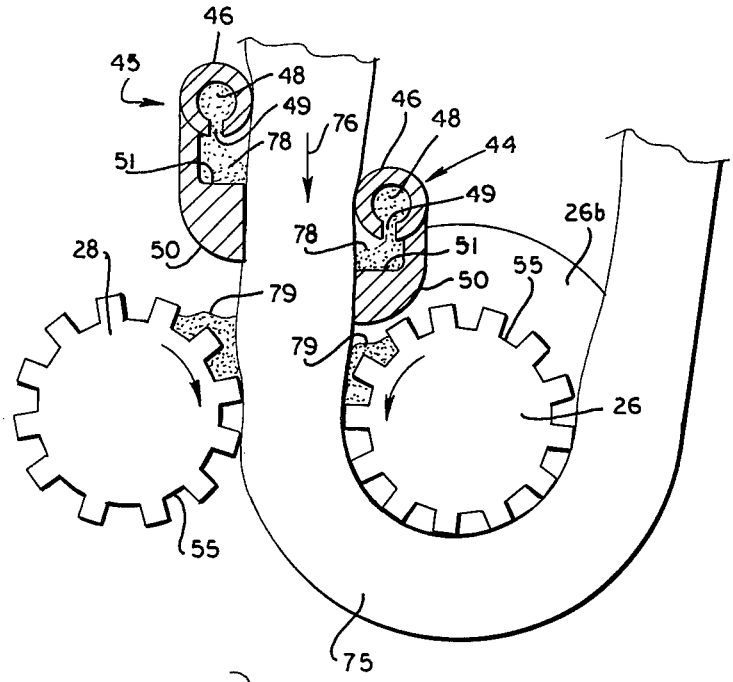
FIG. 3 is a detail schematic side elevational view of the lower rolls and dye applicators and the downwardly moving portion of the annular yarn package.

The liquid moving to the dye applicators (FIG. 3) flows through the conduits 46 and then downwardly through the openings 49 into the troughs 51. Since the troughs open in the direction facing the yarn package, the liquid, which is indicated in FIG. 3 at 78, builds up in the trough 51 and flows into the package and is carried away in a downward direction by the package. Since the squeeze rolls 28 are urged into engagement with the moving packages, the squeezing effect by the squeeze rolls 28 and lower driving roll 26 tends to expel air from the packages 75 as the packages move toward the area between the lower rolls, and the liquid tends to form puddles 79 between the package 75 and the lower rolls 26 and 28. Discrete quantities of the liquid are trapped in the grooves 55 of the lower rolls 26 and 28 and are carried with the rolls and maintained in contact with the yarn packages, so that the liquid has an opportunity to be absorbed into the yarn packages. As the yarn packages begin to emerge from between the lower rolls 26 and 28, the packages begin to expand slightly, whereupon the trapped liquid in the grooves of the rolls is more able to move into and be carried by the yarn packages. Also, the grooves 55 in all of the rolls 25, 26 and 28 cause the rolls to frictionally engage the yarn package so that the yarn packages which are driven by the lower driving rolls 26 functions to drive the upper rolls 25 and the lower squeeze roll 28.

The speed of rotation of the rolls in the system is gauged with respect to the rate of flow and the volume of liquid from the water container 56 and dye container 58, so that several revolutions of the yarn packages 75 are completed as the water and dye liquor flow to the dye applicators 44 and 45. Thus, the annular shaped yarn package is squeezed and released several times during the dyeing process so as to assure uniform penetration of the dye in the package. The volume of dye liquor and water is calibrated in accordance with the type and volume of material being dyed, so that the amount of run-off, if any, is minimized.

When the dyeing process is completed, the operator deenergizes the driving motor for the lower driving rolls 26 to stop the movement of the yarn packages, and deactuates fluid actuated cylinders 34 and 41 to move the squeeze rolls 28 from the lower driving roll and to move the upper rolls 25 downwardly, whereupon the annular shaped yarn packages can be removed by the operator.

While the operation of the system has been described as being controlled by an operator, it should be understood that an automatic timed control operator is used to control the operating steps described herein.

While this invention has been described in detail with particular reference to preferred embodiments thereof, it will be understood that variations and modifications can be effected within the spirit and scope of the invention as described hereinbefore and as defined in the appended claims.

I claim:

1. Apparatus for dyeing packages of yarn and the like comprising a pair of parallel horizontal lower rolls, an upper roll extending parallel to and over said lower rolls, means for rotating at least one of the rolls, a horizontal trough positioned above each of said lower rolls, and means for moving said upper roll and said lower rolls toward and away from each other and for moving said horizontal troughs toward and away from each other, whereby an annular package of yarn and the like is draped about the upper roll and one of the lower rolls, the upper roll and the lower roll about which the package is draped moved away from each other to stretch the package, the lower rolls and troughs moved toward each other to engage the yarn package, one of the rolls rotated to move the package about the rolls, and liquid applied to the package through the troughs.

2. The apparatus of claim 1 and wherein the rolls about which the skein is to be draped include flanges at their opposite ends, with the flanges of one roll being horizontally offset from the flanges of the other roll, whereby the rolls with flanges are movable together with their flanges in overlapping relationship.

3. The apparatus of claim 1 and wherein at least one of said rolls includes a plurality of grooves extending about its surface.

4. The apparatus of claim 1 and wherein said upper roll includes a circular flange at one end and a slotted flange at its other end, with the slots of the slotted flange movable about said one of said troughs.

5. The apparatus of claim 1 and further including water supply means, a liquid dye supply means, and control means for delivering water from said water supply means and dye from said dye supply in predetermined quantities to said troughs.

6. Apparatus for dyeing annular shaped packages of yarn and the like comprising a housing, an upper roll in said housing rotatable about a horizontal axis, a lower driving roll in said housing below said upper roll and rotatable about a horizontal axis, flanges mounted on the ends of said upper roll and said lower driving roll with the flanges of said upper roll being horizontally displaced from the flanges of said lower driving roll, a lower squeeze roll in said housing at approximately the same level of said lower driving roll and rotatable about an axis parallel to the axis of rotation of said lower driving roll, a liquid applicator above said lower driving roll, a liquid applicator above said lower squeeze roll, means for moving said upper roll toward and away from said lower driving roll, means for moving said lower squeeze roll toward and away from said lower drive roll, means for supplying a predetermined volume of liquid to said liquid applicators, and means for rotating said lower drive roll.

7. The apparatus of claim 6 and wherein said upper roll, said lower drive roll and said squeeze roll each include grooves in their external surfaces.

8. The apparatus of claim 6 and wherein said means for moving said lower squeeze roll toward and away from said lower driving roll includes means for moving said liquid applicator above said lower squeeze roll in unison with said lower squeeze roll when said lower squeeze roll is moved toward or away from said lower driving roll.

9. The apparatus of claim 6 and wherein said liquid applicators each comprise a horizontal trough with an open side facing the other liquid applicator.

10. The apparatus of claim 6 and wherein a flange of said upper roll defines a series of slots therein, with one of said slots insertable about said liquid applicator when said upper roll is moved toward said lower driving roll.

* * * * *